US007819230B2

(12) United States Patent
Gerstenkorn

(10) Patent No.: US 7,819,230 B2
(45) Date of Patent: Oct. 26, 2010

(54) METHOD OF ASSIGNING A USER TO AN ELEVATOR SYSTEM AND SUCH AN ELEVATOR SYSTEM

(75) Inventor: Bernhard Gerstenkorn, Ebikon (CH)

(73) Assignee: Inventio AG, Hergiswil NW (CH)

( * ) Notice: Subject to any disclaimer, the term of this patent is extended or adjusted under 35 U.S.C. 154(b) by 735 days.

(21) Appl. No.: 11/734,044

(22) Filed: Apr. 11, 2007

(65) Prior Publication Data

US 2007/0240943 A1 Oct. 18, 2007

(30) Foreign Application Priority Data

Apr. 13, 2006 (EP) ..... 06112652

(51) Int. Cl.
*B66B 3/00* (2006.01)

(52) U.S. Cl. ..... 187/391

(58) Field of Classification Search ..... 187/391
See application file for complete search history.

(56) References Cited

U.S. PATENT DOCUMENTS 2,654,084 A * 9/1953 Wilkie ..... 342/33
5,551,533 A 9/1996 Nb
6,002,138 A * 12/1999 Bond et al. ..... 250/504 R
2004/0055447 A1* 3/2004 Childs et al. ..... 84/615
2006/0129308 A1* 6/2006 Kates ..... 701/200

FOREIGN PATENT DOCUMENTS

JP 2004189278 A 7/1992
JP 2006056363 A 3/1994
JP 11165969 A * 6/1999
JP 2002348055 A * 12/2002
WO WO 2005/118450 A 12/2005

OTHER PUBLICATIONS machine translation of JP 2003348055 A.*

* cited by examiner

*Primary Examiner*—Walter Benson
*Assistant Examiner*—Kawing Chan
(74) *Attorney, Agent, or Firm*—Fraser Clemens Martin & Miller LLC; William J. Clemens

(57) ABSTRACT

A method of assigning a user to an elevator system with several elevators wherein a user issues a destination call, at least one elevator is determined to serve the destination call and is announced to the user by an acoustic signal that identifies the elevator. All of the signals that designate the different elevators are exclusively formed by one single single-frequency signal tone, the various signals that identify the individual elevators being distinguishable to the user by a predefined signal duration and/or at least one predefined signal interruption. The invention further relates to an elevator system that is equipped for this method.

4 Claims, 2 Drawing Sheets

METHOD OF ASSIGNING A USER TO AN ELEVATOR SYSTEM AND SUCH AN ELEVATOR SYSTEM

FIELD OF THE INVENTION

The present invention relates to a method of assigning a user to an elevator system with several elevators, wherein the user issues a destination call and at least one elevator to serve the destination call is determined and, by means of an acoustic signal that designates the elevator, is announced to the user. The invention further relates to such an elevator system.

BACKGROUND OF THE INVENTION

Conventionally, the allocation of a user to an elevator system takes place primarily by means of optical signal modules as, for example, by means of display modules provided in the vicinity of the hoistway doors. After issuing the destination call, the user on the landing of the respective floor must observe the display modules of the various elevators to recognize which elevator he must board so as to be transported into the desired destination floor. However, such an allocation is not suitable for persons who are visually impaired, and especially not for persons who are visually disabled.

From document WO 2005/118450 A1, an elevator system (FIG. 1) with several elevators 26 through 29 is known in which, in the vicinity of each floor and each elevator, a so-called elevator identifier 32*a* through 35*a* is provided that issues a melodic sound that designates the respective elevator or a group of elevators. The sound of the melodies is constructed in such manner that a plurality of different-sounding melodies is available for the various elevators. Provided for the purpose of issuing a destination call (FIG. 2) is a destination call issuing module 39*a* that has a plurality of switches 45 through 51 and a loudspeaker 54. In the module, the switches that are assigned to the various destination floors are identified with Braille markings.

However, an elevator system of this type has the disadvantage that for the purpose of identifying the plurality of elevators, melodies must be created that are clearly distinguishable and, as a consequence, relatively elaborately designed acoustic signal modules as, for example, an MP3 Player or similar device must be implemented.

SUMMARY OF THE INVENTION

A task of the present invention is to develop further a method of assigning a user to an elevator system of the type stated at the outset in such manner that allocation of the user takes place by means of the acoustic signal in simple manner and with simply constructed components. A further task is to specify such an elevator system for execution of this method.

As solution to this task in accordance with the present invention, in a method of the type stated at the outset it is foreseen that all of the signals that designate the different elevators are exclusively formed by means of one single single-frequency signal tone, the various signals that identify the individual elevators being recognizable by a predefined signal duration and/or at least one predefined signal interruption that are distinguishable for the user.

The method according to the present invention is based on the knowledge that, on announcement of the determined elevator, the identification of various elevators by the signal tone having a certain frequency is achieved in that the signal tone is interrupted by pauses, continues for a defined period of time, and/or is configured by a combination of these design characteristics. In this way, the signal can be constructed in the form of a signal code, in other words by sounds of various lengths with pauses selectably inserted between them. For this purpose it is preferable to use the so-called Morse code, that has as its basis a single unvarying unmodulated signal, as a result of which it requires relatively little hardware and as a result of which a simply constructed single-frequency emitter can be used as acoustic signal module.

In a further advantageous development of the method, the signals are configured by means of a predefined signal code, preferably by means of the Morse alphabet code.

Should several suitable elevators be determined to serve the destination call, the signals that are defined for each of the determined elevators can be issued separated from each other in time.

In a further advantageous development, the user issues the destination call by actuating once or more at least one switch of a destination call issuing module. It is possible, for example, for a destination call issuing module to be provided that has only one switch in the access area of each floor of the elevator system that makes it possible for the user to specify the desired destination floor by actuating the switch the corresponding number of times. For example, to communicate his destination call for a trip into the fifth floor, he actuates the switch by pressing it five times. The destination call issuing module can also expediently contain an acoustic signal module so that each actuation of the switch is confirmed by a single-frequency signal tone.

In a further embodiment, the user is guided to the destination call issuing module by an acoustic signal. By this means it can be ensured that, after a visually disabled person enters a building, they are first guided by an acoustic signal in the form of a single-frequency signal tone or a melody that consists of a plurality of tones to the destination call issuing module so that the person can issue their destination call.

Furthermore, for the solution of the aforesaid task, an elevator system with several elevators is proposed that has at least one destination call issuing module for issuing a destination call, a destination call control module to determine an elevator to serve the destination call, and at least one acoustic signal module to issue an acoustic signal to assign the user to the determined elevator, the signals that identify all of the different elevators being exclusively formed by means of one single single-frequency tone, the various signals that identify the individual elevators being recognizable by a predefined signal duration and/or at least one predefined signal interruption that is distinguishable for the user.

An elevator system that is executed in such manner makes use of the advantages of the method according to the present invention. According to the foregoing description of the method according to the present invention, it is advantageous if the signals are configured by means of a predefined signal code, preferably by means of the Morse alphabet code, to designate various elevators.

It is advantageous for the destination call issuing module to be provided in the vicinity of the elevator landing and to have at least one switch. It is preferable for the destination call issuing module to comprise several switches, each switch being identified by a haptic means of designating the function of the switch, for example the destination floor. Thus, for example, a telephone keypad or a number of switches that corresponds to the floor can be provided, each of the switches being provided with a designation of the floor in the form of Braille by means of a corresponding surface structure that for a visibly disabled person is detectable by the sense of touch. It is preferable for the signal module to be arranged in the vicinity of the elevator hoistway door, in the vicinity of the elevator car, and/or in the landing area of the elevator of the respective floor. It is preferable for there to be provided in the entrance area of each stop of the elevator system at least one destination call issuing module.

It is advantageous for the destination call issuing module to be provided with a further switch, designated with an optically and haptically recognizable handicap symbol. The function of this pushbutton is that the acoustic signals are only generated when this pushbutton is actuated before the destination is entered to prevent the surroundings being constantly subjected to the sound of signal tones.

It is advantageous for the destination call issuing module to be provided with an RFID reader device and for the disabled person to have a card or mobile telephone that is detectable by this reader device. In association with this card, the travel destination and the type of disability are stored. The disabled person need only bring this card into the proximity of the reader device for the destination call to be issued and to automatically receive the acoustic orientation aid.

The method according to the present invention and the device are explained further below by reference to an exemplary embodiment.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
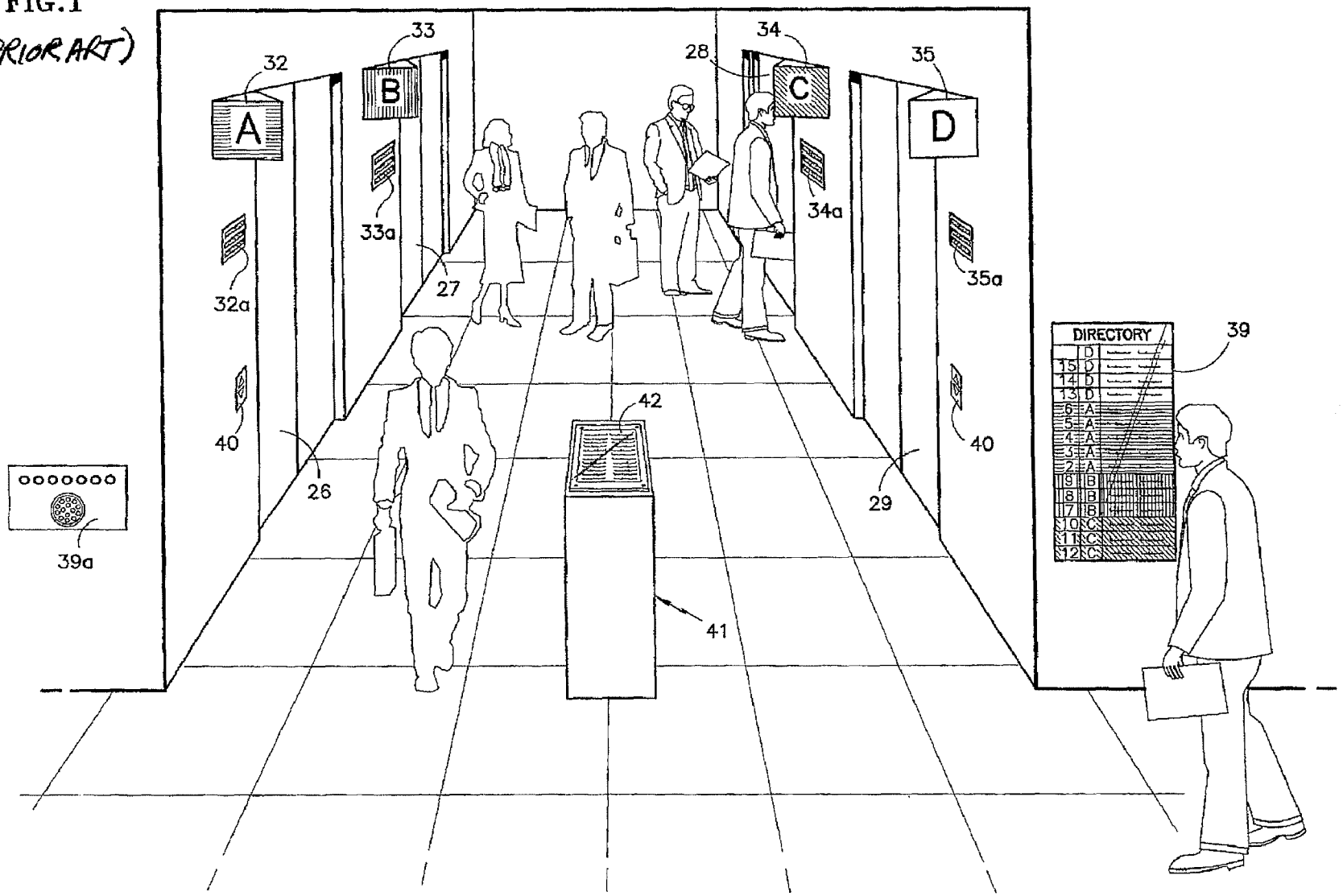
FIG. 1 (PRIOR ART)
FIG. 1 is a schematic perspective view of a prior art elevator lobby.
Figure 2:
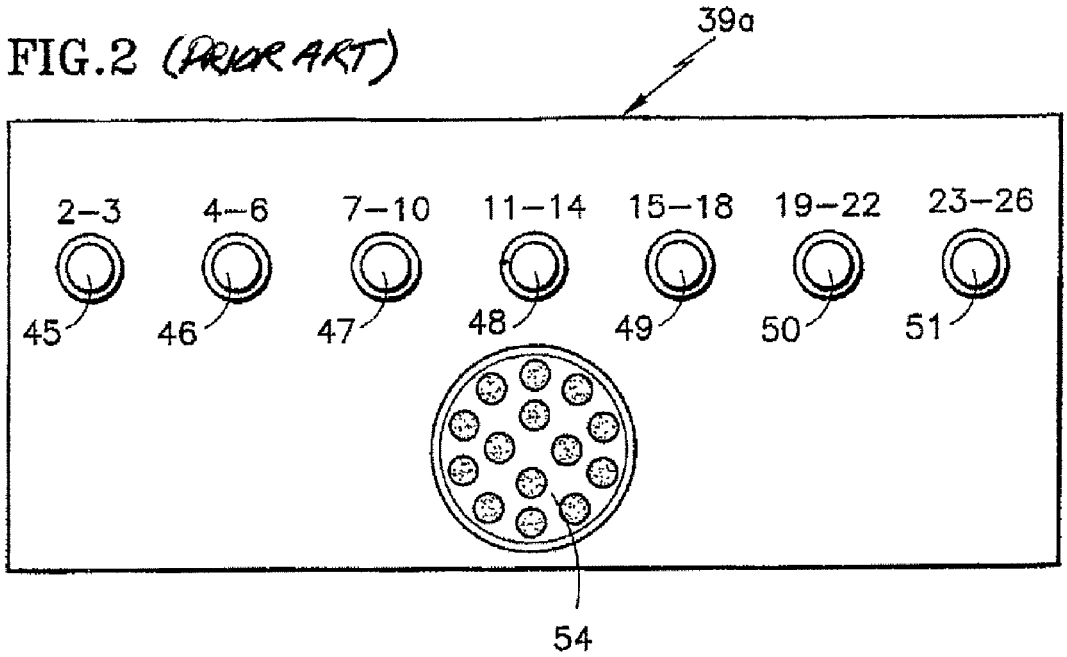
FIG.2 (PRIOR ART)
FIG. 2 is a front elevation view of the elevator floor selection station shown in FIG. 1.
Figure 3:
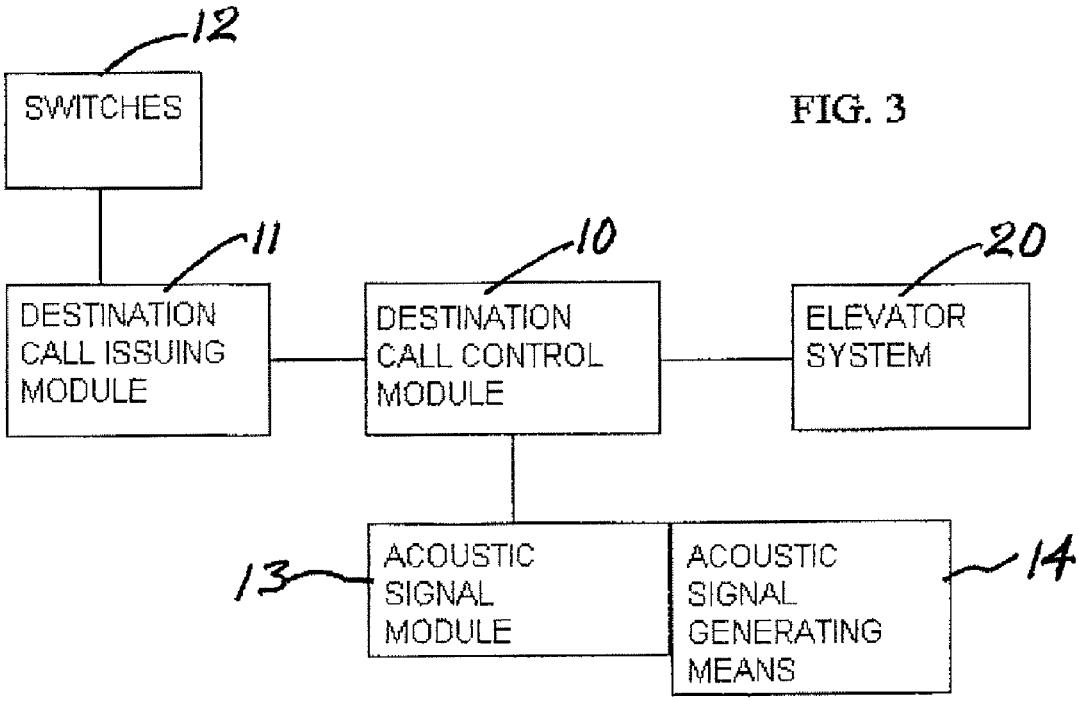
FIG. 3 is a block diagram of the elevator system for performing the method according to the present invention.

An elevator system 20 according to the present invention comprises several elevators (elevators 26 through 29 of FIG. 1) that are capable of traveling between a plurality of floors. Provided for the purpose of controlling the elevator system 20 is a control module 10 with a destination call issuing module 11 that receives a destination call issued by a user and thereupon determines at least one elevator that is suitable for serving the destination call. For the purpose of issuing the destination call, in the area of each landing area of the elevator system is the destination call issuing module 11 with a number of switches 12 that corresponds to the number of floors. Each of the switches 12 is provided with haptic means in the form of Braille marks with projections to designate a floor. In addition, assigned to each elevator hoistway door is an acoustic signal module 13. This signal module 13 comprises a single-frequency signal tone emitter 14, an acoustic signal generating means, that is so equipped as to emit a sequence of single-frequency signal tones that are separated by pauses for assigning the user to one of the elevator hoistway doors.

If, now, a visually disabled person enters a building that is equipped with such an elevator installation and, in the area of the ground floor in the lobby area of the elevator system, arrives at the destination call issuing module 11, by means of his sense of touch this user can identify that switch 12 that is marked with Braille that corresponds to his desired destination floor. After actuation of the respective switch 12, this destination call is transmitted to the destination call issuing module 11. The destination call control module 10 determines a suitable elevator for transporting the user into the desired destination floor and gives the user the associated designation of the elevator, for example a letter or number, by means of a correspondingly configured single-frequency signal tone by means of the acoustic signal module 13 of the destination call issuing module. Thus, for example, four elevators A, B, C, D that are present in the elevator system can be designated by the following sequences of signal tones ("-"=long; "."=short): Elevator A "- - -" Elevator B ". - - "; Elevator C "- . -"; and Elevator D ". . -". Between the individual signal tone components "long" and "short", signal interruptions that are also of predefined length are provided. Afterwards, the same single-frequency signal tone sounds from the signal module 13 of the assigned elevator hoistway door.

In this manner, the visually disabled person can orientate himself by means of the signal tone and move in the direction of the assigned elevator hoistway door. In addition, it can be foreseen that after arrival of the elevator car in the starting floor, and after opening of the elevator hoistway door and elevator car door, a further acoustic signal module that is arranged in or on the elevator car issues the same signal tone to communicate to the user that he can now board the elevator car.

The exemplary embodiment described above relates to the method according to the present invention as well as to the elevator installation according to the present invention, and is especially characterized in that through the use of a single-frequency tone emitter, a comparatively simply constructed acoustic signal module can be used and that it is also not necessary to hold ready a plurality of elaborately melodic sounds.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of assigning a user to an elevator system with a plurality of elevators, the method comprising the steps of:

providing the elevator system with at least one destination call issuing module for issuing a destination call, the destination call issuing module including at least one switch used to designate a floor of the designation call, a destination call control module to determine at least one of the elevators to serve the destination call, a plurality of acoustic signal modules to issue acoustic signals to assign the user to the determined elevator, one of the acoustic signal modules assigned to the destination call issuing module for issuing the destination call to guide the user to the destination call issuing module, the other acoustic signal modules assigned to different ones of the elevators to guide the user to communicate to the user that the determined elevator can be boarded, and an acoustic signal generating means in each acoustic signal module for generating the acoustic signals;

guiding the user to the destination call issuing module by a first acoustic signal issued from the acoustic signal module of the destination call issuing module, the first acoustic signal in the form of a single-frequency signal tone with a predefined signal duration and at least one predefined signal interruption that is distinguishable to the user;

permitting the user to issue the destination call by actuating the at least one switch of the destination call issuing module;

determining at least one of the elevators to serve the destination call;

designating the at least one elevator determined to serve the destination call by a second acoustic signal, the second acoustic signal consisting of a single single-frequency signal tone with a predefined signal duration and at least one predefined signal interruption that is distinguishable to the user;

announcing to the user through the acoustic signal module of the destination call issuing module the one of the elevators determined to serve the destination call with the second acoustic signal; and announcing to the user through the acoustic signal module of the one of the elevators determined to serve the destination call with the second acoustic signal that the one of the elevators determined to serve the destination call can be boarded.

2. The method according to claim 1 including configuring the acoustic signals with a predetermined signal code.

3. The method according to claim 2 wherein the predetermined signal code is a Morse alphabet code.

4. The method according to claim 1 including emitting the acoustic signals for the elevators separated by time from one another.

* * * * *